US011793369B1

(12) United States Patent
Yang

(10) Patent No.: US 11,793,369 B1
(45) Date of Patent: Oct. 24, 2023

(54) POTTY CHAIR

(71) Applicant: Taizhou Xiaotanglang Infant and Child Products Co., Ltd., Taizhou (CN)

(72) Inventor: Saisai Yang, Taizhou (CN)

( * ) Notice: Subject to any disclaimer, the term of this patent is extended or adjusted under 35 U.S.C. 154(b) by 0 days.

(21) Appl. No.: 18/328,150

(22) Filed: Jun. 2, 2023

(30) Foreign Application Priority Data

Jul. 26, 2022 (CN) ..... 202221945563.4

(51) Int. Cl.
*A47K 11/04* (2006.01)

(52) U.S. Cl.
CPC ..... *A47K 11/04* (2013.01)

(58) Field of Classification Search
CPC ..... A47K 11/04
USPC ..... 4/483
See application file for complete search history.

(56) References Cited

U.S. PATENT DOCUMENTS 11,330,942 B1 * 5/2022 Bergman ..... A47K 11/04
D975,250 S * 1/2023 Jiang ..... D23/299
D988,484 S * 6/2023 Yang ..... D23/296
11,672,386 B1 * 6/2023 Kasmar ..... A47K 11/02 4/483
2010/0043132 A1 * 2/2010 Viglietta ..... A47K 11/06 4/483
2014/0007335 A1 * 1/2014 Ukaegbu ..... A47K 11/04 4/300
2022/0183517 A1 * 6/2022 Yang ..... A47K 11/04

* cited by examiner

*Primary Examiner* — Huyen D Le

(57) ABSTRACT

The present disclosure provides a potty chair. The potty chair includes an upper main body and a lower main body. A sitting platform is arranged at an upper end of the upper main body, an excretion hole and an excrement container mounted in the excretion hole and configured for accommodating excrement are arranged in the sitting platform. The lower main body is detachably connected to a lower end of the upper main body and configured for supporting the upper main body. A first accommodating cavity is formed in the lower main body. When the upper main body is separated from the lower main body, a volume formed by stacking the upper main body and the lower main body is reduced by placing the lower main body upside down and placing the lower end of the upper main body in the first accommodating cavity.

20 Claims, 13 Drawing Sheets

POTTY CHAIR

CROSS-REFERENCE TO RELATED APPLICATIONS

The present disclosure claims priority of Chinese patent application CN202221945563.4, filed on Jul. 26, 2022, which is incorporated herein by reference in its entireties.

TECHNICAL FIELD

The present disclosure belongs to the technical field of children's products, in particular to, a potty chair.

BACKGROUND

Commonly used toilets or squatting pans are mainly designed for adults. Due to a large toilet sitting platform on a toilet and the short stature of children, the commonly used toilets are not convenient for children. There is currently a potty chair on the market. The potty chair is made of plastic and has a shape and structure basically the same as those of existing toilets, but its size is suitable for the statures of children, making it easy for children to use this potty chair and to learn life skills.

However, the existing potty chair is overall integrally manufactured through a mold. From the perspective of product packaging, the volume of the existing potty chair is still relatively large, which will increase the packaging and transportation costs of the potty chair. Especially when the potty chair is exported overseas, the costs due to the packaging volume will be greatly increased. Therefore, how to reduce the transportation volume is an urgent problem to be solved in existing potty chair.

SUMMARY

The present disclosure aims to provide a potty chair.

The objective of the present disclosure is achieved below: a potty chair including: an upper main body, wherein a sitting platform is arranged at an upper end of the upper main body; an excretion hole and an excrement container mounted in the excretion hole and configured for accommodating excrement are arranged in the sitting platform; and a lower main body, detachably connected to a lower end of the upper main body and configured for supporting the upper main body, wherein a first accommodating cavity is formed in the lower main body; when the upper main body is separated from the lower main body, a volume formed by stacking the upper main body and the lower main body is reduced by placing the lower main body upside down and placing the lower end of the upper main body in the first accommodating cavity.

Further, the lower main body is hollowed; an upper connecting port matched with the lower end of the upper main body in size is formed in an upper end of the lower main body; an outer diameter of the lower main body gradually increases from the upper connecting port to bottom; and the first accommodating cavity is formed in the lower main body.

Further, a connecting boss is arranged at an inner edge of the upper connecting port; and several corresponding connecting holes are formed in the connecting boss and the upper main body.

Further, several first connecting seats are arranged on the connecting boss; several second connecting seats corresponding to the first connecting seats are arranged on the upper main body; the connecting holes are formed in the first connecting seats and the second connecting seats; and slots matched with the second connecting seats in shape are formed in upper side surfaces and lower side surfaces of the first connecting seats.

Further, the upper main body is hollowed; a third accommodating cavity located below the excrement container is arranged in the upper main body; and the third accommodating cavity is configured for accommodating accessories of the potty chair when the upper main body and the lower main body are folded.

Further, the sitting platform on a rear side of the excretion hole is detachably connected with a water tank decoration member; the water tank decoration member includes: a base, configured for being detachably connected to the sitting platform; at least one extending wall, detachably fixed on the base; and an end cover, detachably fixed on the extending wall, wherein a second accommodating cavity matched with the base in size is formed in the extending wall; and when the water tank decoration member is disassembled, the base is arranged in the second accommodating cavity to fold the water tank decoration member.

Further, several connecting plugs are arranged on the sitting platform; several connecting slots matched with the connecting plugs are formed in a bottom of the base; and corresponding fastener components are arranged on the connecting plugs and the connecting slots.

Further, a sliding chute is formed in the base; a guide sleeve is fixed at one end of the sliding chute; a sliding rod is arranged in the sliding chute; and one end of the sliding rod is arranged in the guide sleeve in a penetrating manner, and the other end is provided with a limiting boss configured for abutting against the guide sleeve.

Further, a recessed portion is arranged in the end cover; a recessed cavity configured for placing an object is formed in the recessed portion; a flap cover configured for closing the recessed cavity is arranged at a top of the recessed portion.

Further, the potty chair further includes a simulation toy and the simulation toy is configured for simulating operations of a toilet and includes a push button and a sound production member connected to the push button, and the push button is pushed to enable the sound production member to work.

The objective of the present disclosure is achieved below: a potty chair including an upper main body, a sitting platform disposed at an upper end of the upper main body and comprising a excretion hole; an excrement container mounted in the excretion hole and configured for accommodating excrement disposed in the sitting platform; and a lower main body, detachably connected to a lower end of the upper main body and configured for supporting the upper main body, wherein a first accommodating cavity is formed in the lower main body, and the first accommodating cavity is configured for accommodating the lower end of the upper main body when the upper main body is separated from the lower main body.

Further, the lower main body is hollowed; an upper connecting port matched with the lower end of the upper main body in size is formed in an upper end of the lower main body; an outer diameter of the lower main body gradually increases from the upper connecting port to bottom; and the first accommodating cavity is formed in the lower main body.

Further, a connecting boss is arranged at an inner edge of the upper connecting port; and several corresponding connecting holes are formed in the connecting boss and the upper main body.

Further, several first connecting seats are arranged on the connecting boss; several second connecting seats corresponding to the first connecting seats are arranged on the upper main body; the connecting holes are formed in the first connecting seats and the second connecting seats; and slots matched with the second connecting seats in shape are formed in upper side surfaces and lower side surfaces of the first connecting seats.

Further, the upper main body is hollowed; a third accommodating cavity located below the excrement container is arranged in the upper main body; and the third accommodating cavity is configured for accommodating accessories of the potty chair when the upper main body and the lower main body are folded.

Further, the sitting platform on a rear side of the excretion hole is detachably connected with a water tank decoration member; the water tank decoration member includes: a base, configured for being detachably connected to the sitting platform; at least one extending wall, detachably fixed on the base; and an end cover, detachably fixed on the extending wall, wherein a second accommodating cavity matched with the base in size is formed in the extending wall; and when the water tank decoration member is disassembled, the base is arranged in the second accommodating cavity to fold the water tank decoration member.

Further, several connecting plugs are arranged on the sitting platform; several connecting slots matched with the connecting plugs are formed in a bottom of the base; and corresponding fastener components are arranged on the connecting plugs and the connecting slots.

Further, a sliding chute is formed in the base; a guide sleeve is fixed at one end of the sliding chute; a sliding rod is arranged in the sliding chute; and one end of the sliding rod is arranged in the guide sleeve in a penetrating manner, and the other end is provided with a limiting boss configured for abutting against the guide sleeve.

Further, a recessed portion is arranged in the end cover; a recessed cavity configured for placing an object is formed in the recessed portion; a flap cover configured for closing the recessed cavity is arranged at a top of the recessed portion.

Further, the potty chair further includes a simulation toy and the simulation toy is configured for simulating operations of a toilet and includes a push button and a sound production member connected to the push button, and the push button is pushed to enable the sound production member to work.

Compared with the prior art, the present disclosure has outstanding and beneficial technical effects: when the potty chair of this patent is folded, the upper main body is partially stored in the first accommodating cavity. Compared with the height of the potty chair in an assembled state, the height of the potty chair in a folded state is greatly reduced, so that the packaging cost of the potty chair can be greatly reduced. Furthermore, the connecting boss that supports the upper main body is arranged in the lower main body, so that a user can directly hold the lower main body to carry the entire folded potty chair, which facilitates carrying and encasement of the potty chair in the folded state.

DETAILED DESCRIPTION OF THE EMBODIMENTS

The present disclosure is further described below in detail in combination with the accompanying drawings and embodiments.

Figure 1:
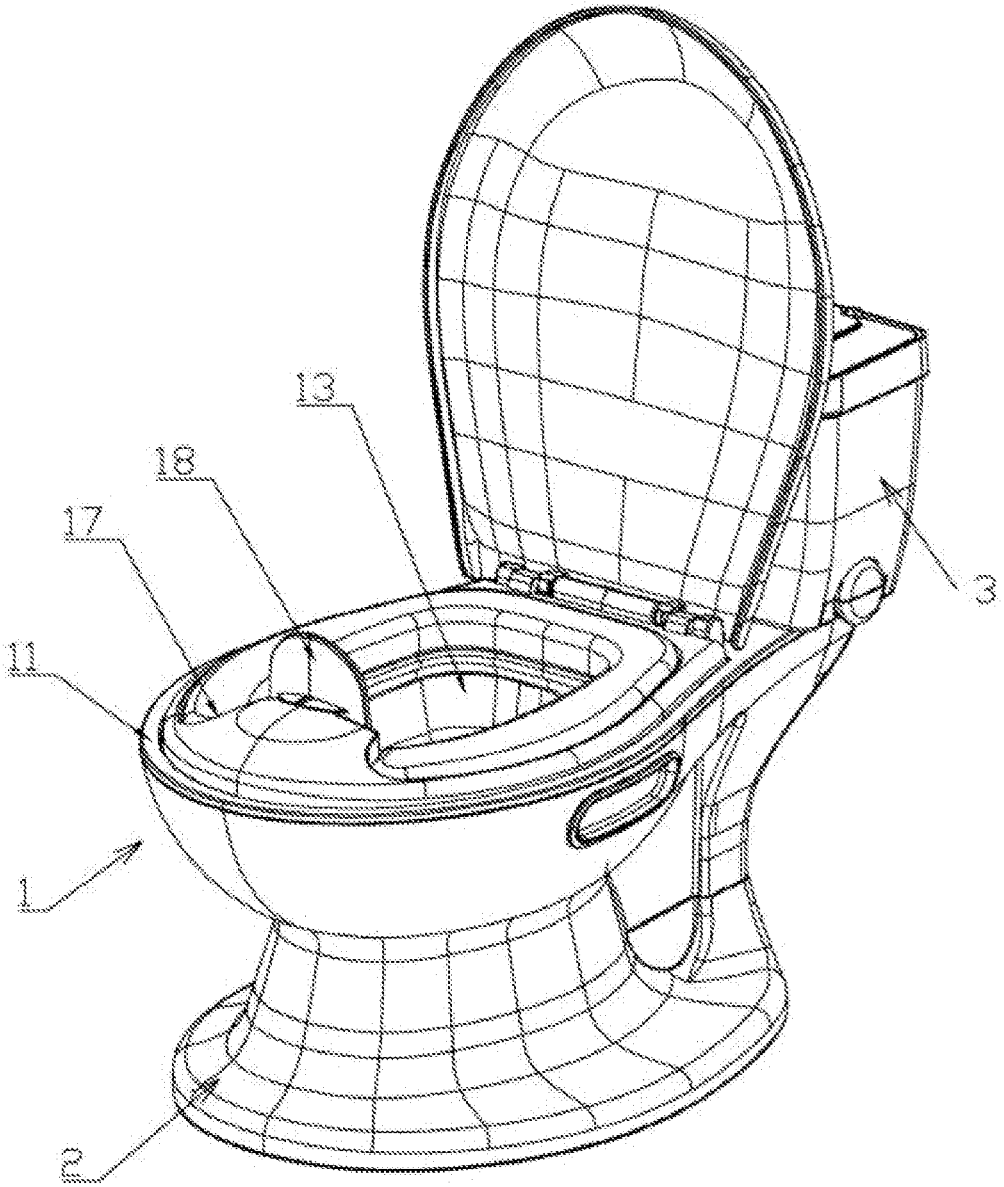
FIG. 1 is a schematic structural diagram of the present disclosure.
Figure 2:
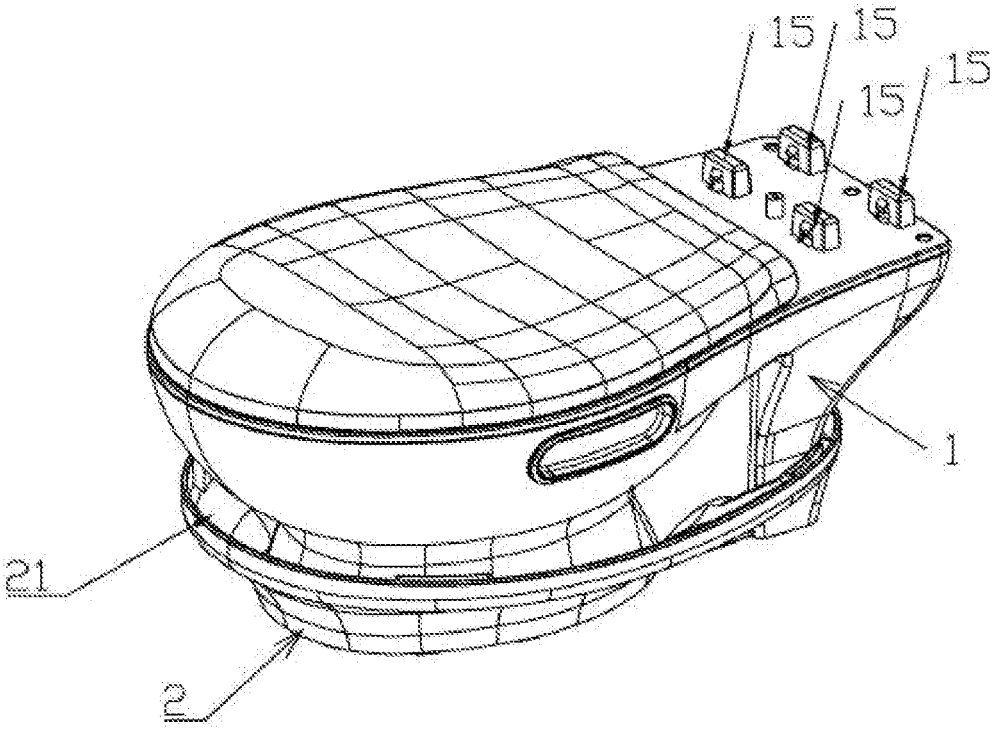
FIG. 2 is a schematic structural diagram of the present disclosure during folding.
Figure 3:
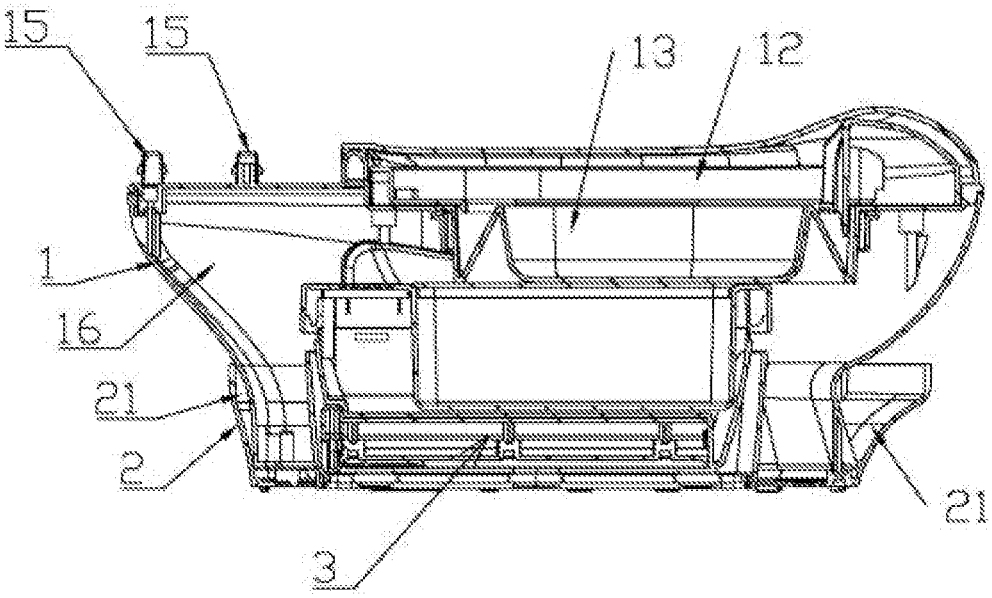
FIG. 3 is a cross-sectional view of FIG. 2.

A potty chair, as shown in FIG. 1, includes an upper main body 1 and a lower main body 2. A sitting platform 11 is arranged at an upper end of the upper main body 1. An excretion hole 12 and an excrement container 13 mounted in the excretion hole 12 and configured for accommodating excrement are arranged in the sitting platform 11. The lower main body 2 is detachably connected to a lower end of the upper main body 1 and is configured for supporting the upper main body 1. As shown in FIG. 2 and FIG. 3, a first accommodating cavity 21 having an outer diameter greater than that of the lower end of the upper main body 1 is formed in the lower main body 2. When the upper main body 1 is separated from the lower main body 2, a volume formed by stacking the upper main body 1 and the lower main body 2 is reduced by placing the lower main body 2 upside down and placing the lower end of the upper main body 1 in the first accommodating cavity 21.

Figure 6:
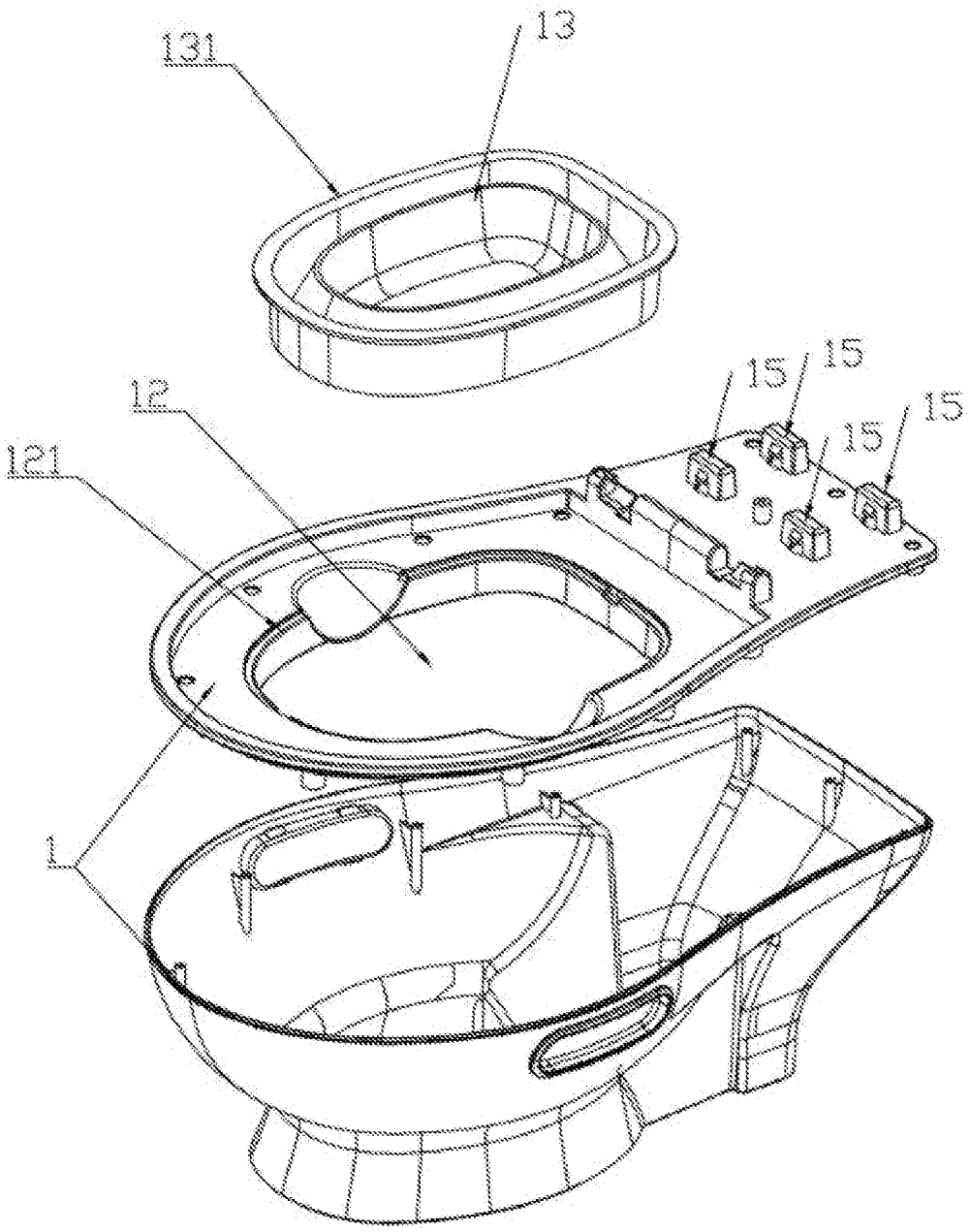
FIG. 6 is an exploded diagram of an upper main body.
Figure 7:
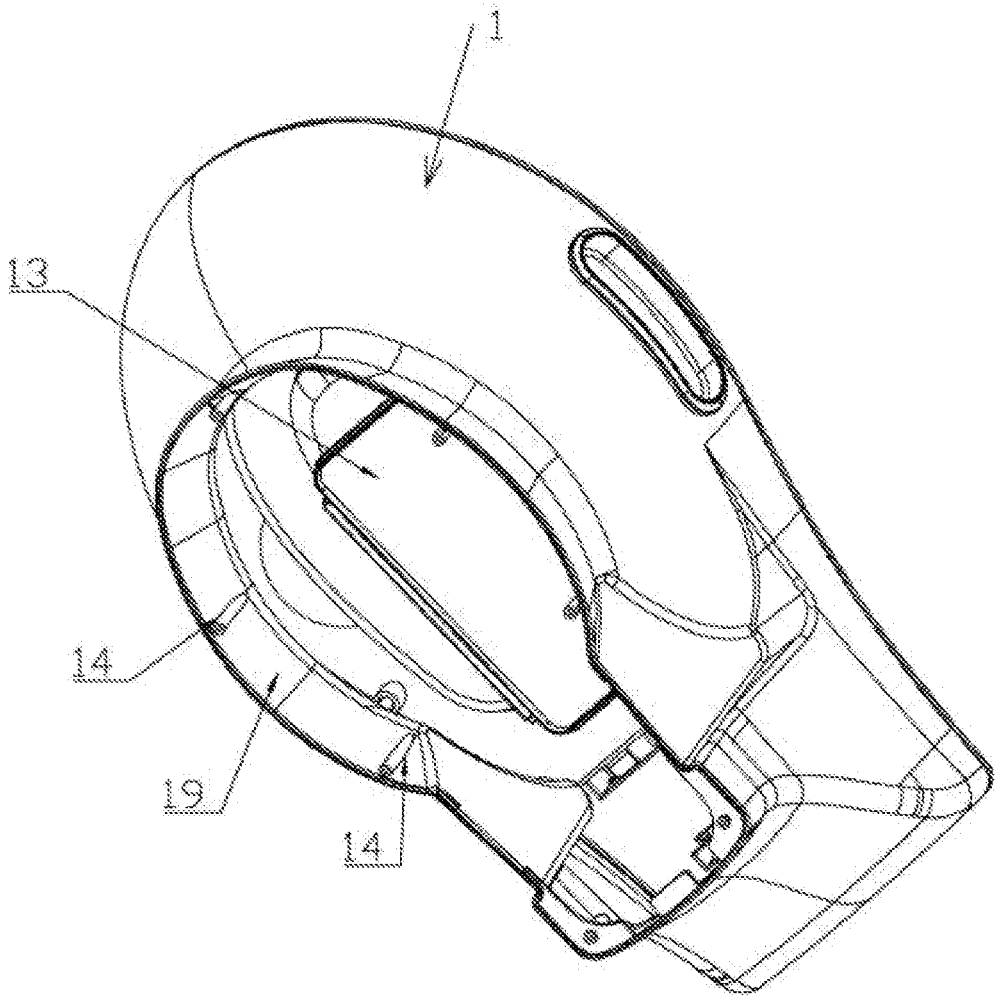
FIG. 7 is a schematic diagram of a bottom of an upper main body.

Specifically, as shown in FIG. 1, FIG. 6, and FIG. 7, the upper main body 1 is composed of two portions, including an annular plate body and a planar plate body detachably connected to an opening in a top of the annular plate body through a screw structure. The annular plate body has a large top and a small bottom, and is configured for matching a shape of a conventional toilet. The sitting platform 11, the excretion hole 12, and a formed on a surface of the planar plate body, and a toilet sitting platform 17 arranged on the sitting platform 11 in a flip manner are formed in a surface of the planar plate body, and a urine stopper 18 is arranged in the toilet sitting platform 17.

In this patent, as shown in FIG. 6, an abutment boss 121 is arranged at an inner edge of the excretion hole 12; an outer boss 131 abutting against the abutment boss 121 is arranged at an outer edge of a top of the excrement container 13. When the excrement container 13 is mounted in the excretion hole 12, the outer boss 131 abuts against the abutment boss 121 for limitation. In addition, the excrement container 13 also has a telescopic structure, which can refer to a soft rubber folding structure in an existing folding bathtub.

Figure 4:
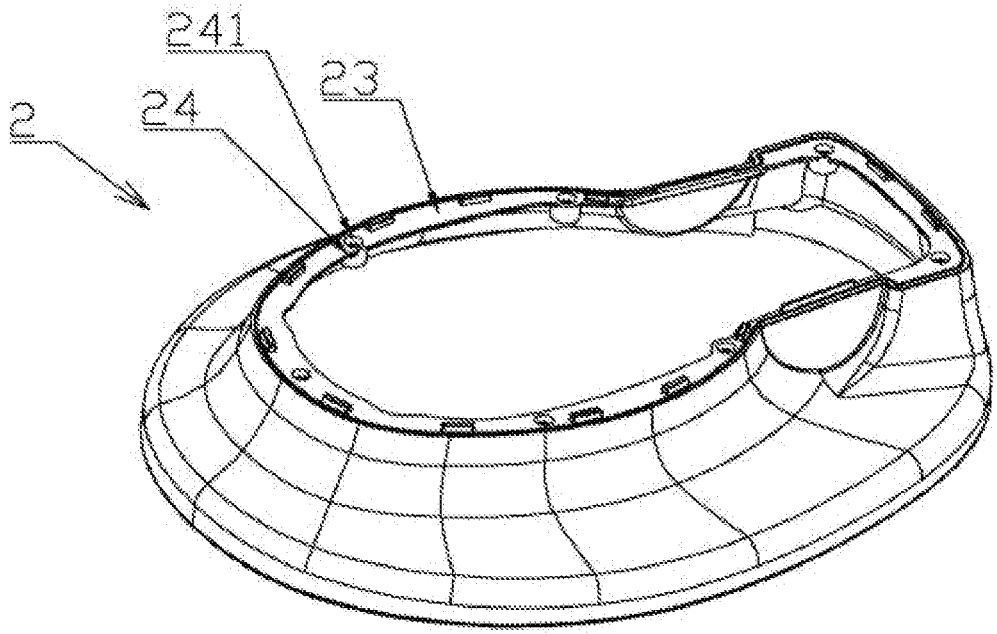
FIG. 4 is a schematic structural diagram I of a lower main body.
Figure 5:
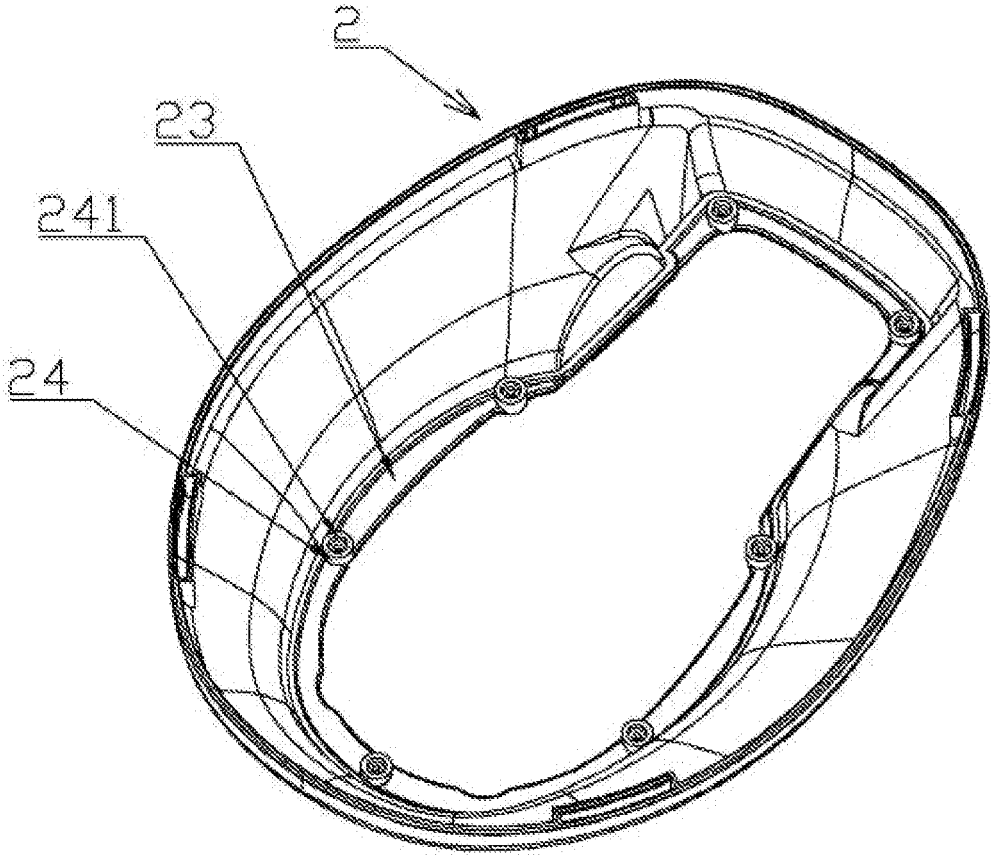
FIG. 5 is a schematic structural diagram II of a lower main body.

As shown in FIG. 4 and FIG. 5, the lower main body 2 is also a hollowed annular plate body. An upper connecting port 22 matched with the lower end of the upper main body 1 in size is formed in an upper end of the lower main body 2. Furthermore, an outer diameter of the lower main body 2 gradually increases from the upper connecting port 22 to bottom, and the lower main body is matched with a bottom of the conventional toilet in shape, so as to improve the stability of supporting of the lower main body 2. The first accommodating cavity 21 is formed in the hollowed annular plate body.

Specifically, a connecting boss 23 is arranged at an inner edge of the upper connecting port 22. Several round connecting seats 24 are distributed on the connecting boss 23 in sequence. Connecting holes are formed in centers of the round connecting seats 24. As shown in FIG. 7, a lower connecting port 19 is formed in a lower end of the upper main body 1. The lower connecting port 19 is matched with the upper connecting port 22 in shape. Several second connecting seats 14 corresponding to the first connecting seats 24 are fixed on an inner edge of the upper connecting port 22 through supporting ridges. Connecting holes are also formed in the second connecting seats 14. Generally, the connecting holes are threaded holes. When the upper connecting port 22 and the lower connecting port 19 are opposite, the upper main body 1 and the lower main body 2 can be connected by arranging screws in the opposite first connecting seats 24 and second connecting seats 14, or the upper main body 1 and the lower main body 2 can be separated by removing the screws.

In this patent, when the upper main body 1 and the lower main body 2 are separated, a user can place the removed lower main body 2 upside down to make the first accommodating cavity 21 in the lower main body 2 exposed to the outside. Next, the user places the lower connecting port 19 of the upper main body 1 in the lower main body 2. The abutment boss 121 is arranged at the inner edge of the upper connecting port 22, so that the lower connecting port may abut against the abutment boss 121 and is supported. In this case, the potty chair of this patent is completely folded. Since the upper main body 1 is partially stored in the first accommodating cavity 21, compared with the height of the potty chair in an assembled state, the height of the potty chair in a folded state is greatly reduced. Thus, the packaging cost of the potty chair can be greatly reduced. Furthermore, the connecting boss 23 that supports the upper main body 1 is arranged in the lower main body 2, so that a user can directly hold the lower main body 2 to carry the entire folded potty chair, which facilitates carrying and boxing of the potty chair in the folded state.

Further, slots 241 matched with the second connecting seats 14 in shape are formed in upper side surfaces and lower side surfaces of the first connecting seats 24. As shown in FIG. 5 and FIG. 7, the slots 241 are directly formed in the first connecting seats 24 during mold shaping of the lower main body 2. As the second connecting seats 14 are relatively thin, and the first connecting seats 24 are relatively wide, when the upper main body 1 and the lower main body 2 are assembled or folded, the slots 241 can accommodate the second connecting seats 14, so as to achieve a connecting and positioning effect and facilitate fast assembling or folding by the user.

In some embodiments, the lower main body 2 may be solid, so as to improve the manufacturing strength of the lower main body 2. A connecting slot is formed in a bottom surface of the lower main body 2 to form the first accommodating cavity 21, which can also achieve folding of the upper main body 1 and the lower main body 2.

Further, the sitting platform 11 on a rear side of the excretion hole 12 is detachably connected with a water tank decoration member 3. The water tank decoration member 3 is configured for simulation. That is, the whole potty chair is more like a conventional toilet due to the water tank decoration member 3, which is convenient for a child to learn life skills. However, arranging the water tank decoration member 3 will greatly increase the height of the whole potty chair. Therefore, in this patent, the water tank decoration member 3 is detachably connected to the sitting platform 11, so that during packaging of the potty chair, the removed water tank decoration member 3 is mounted at another position for storage, to reduce the packaging volume.

Figure 8:
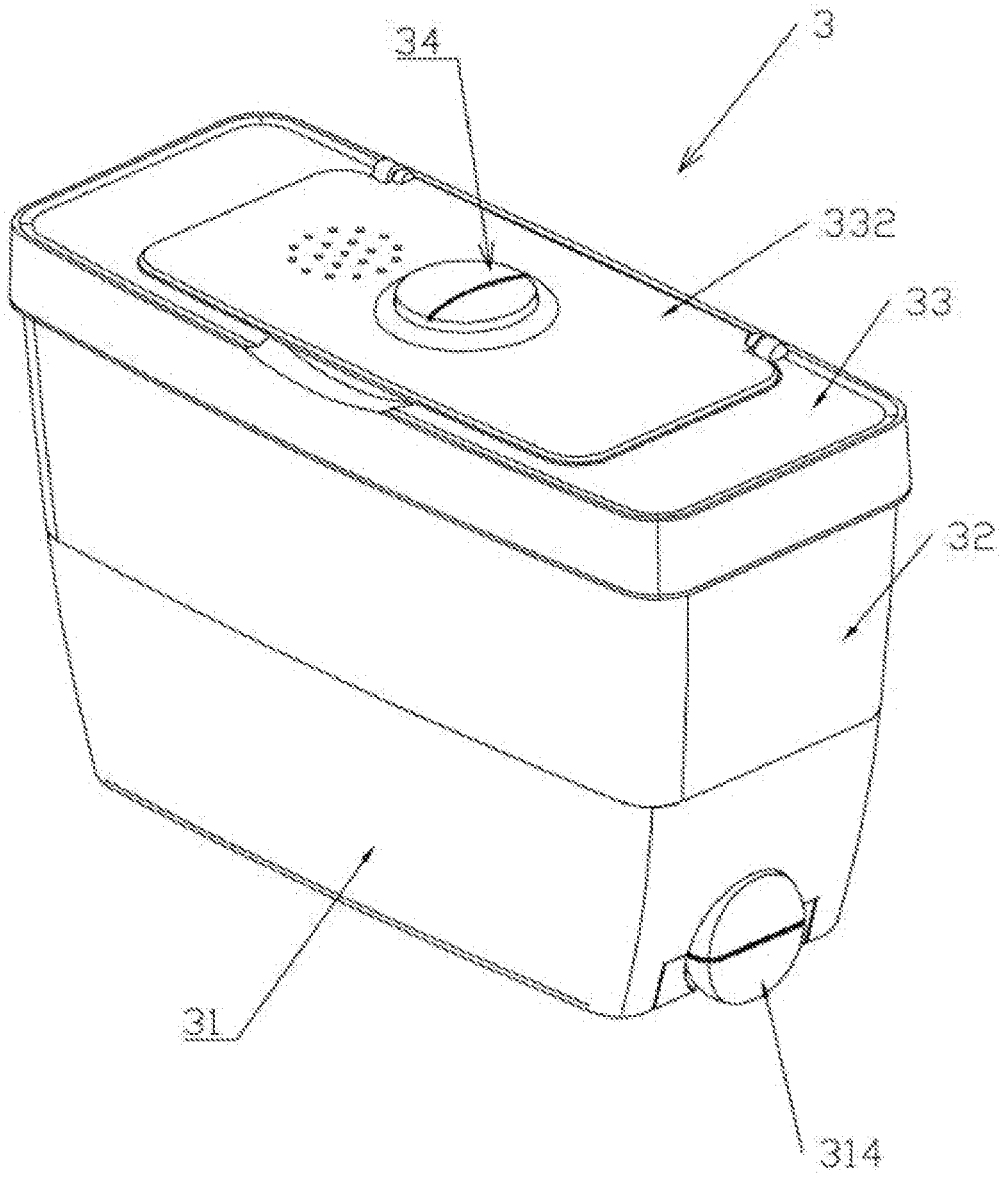
FIG. 8 is a schematic structural diagram of a first kind of water tank decoration member.
Figure 9:
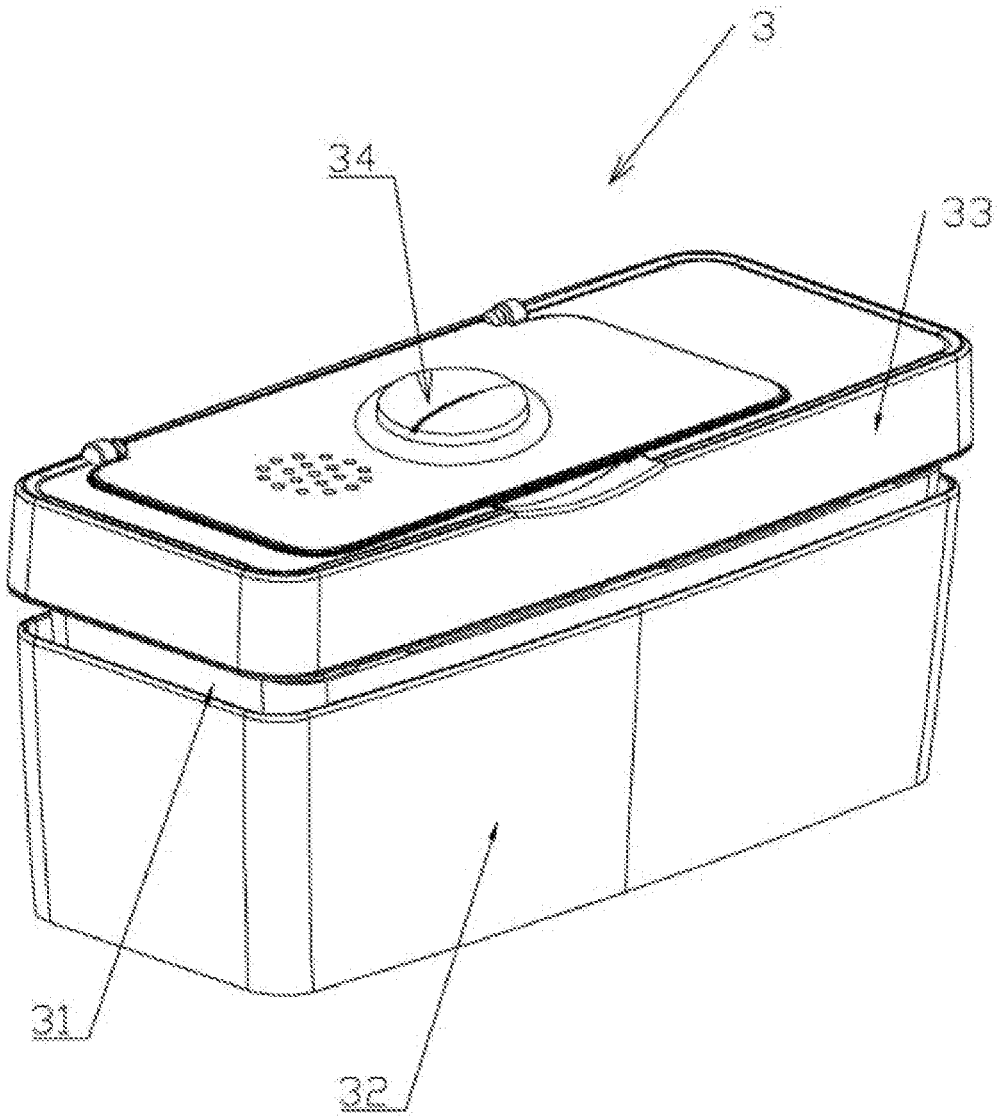
FIG. 9 is a schematic structural diagram of folding a first kind of water tank decoration member.
Figure 10:
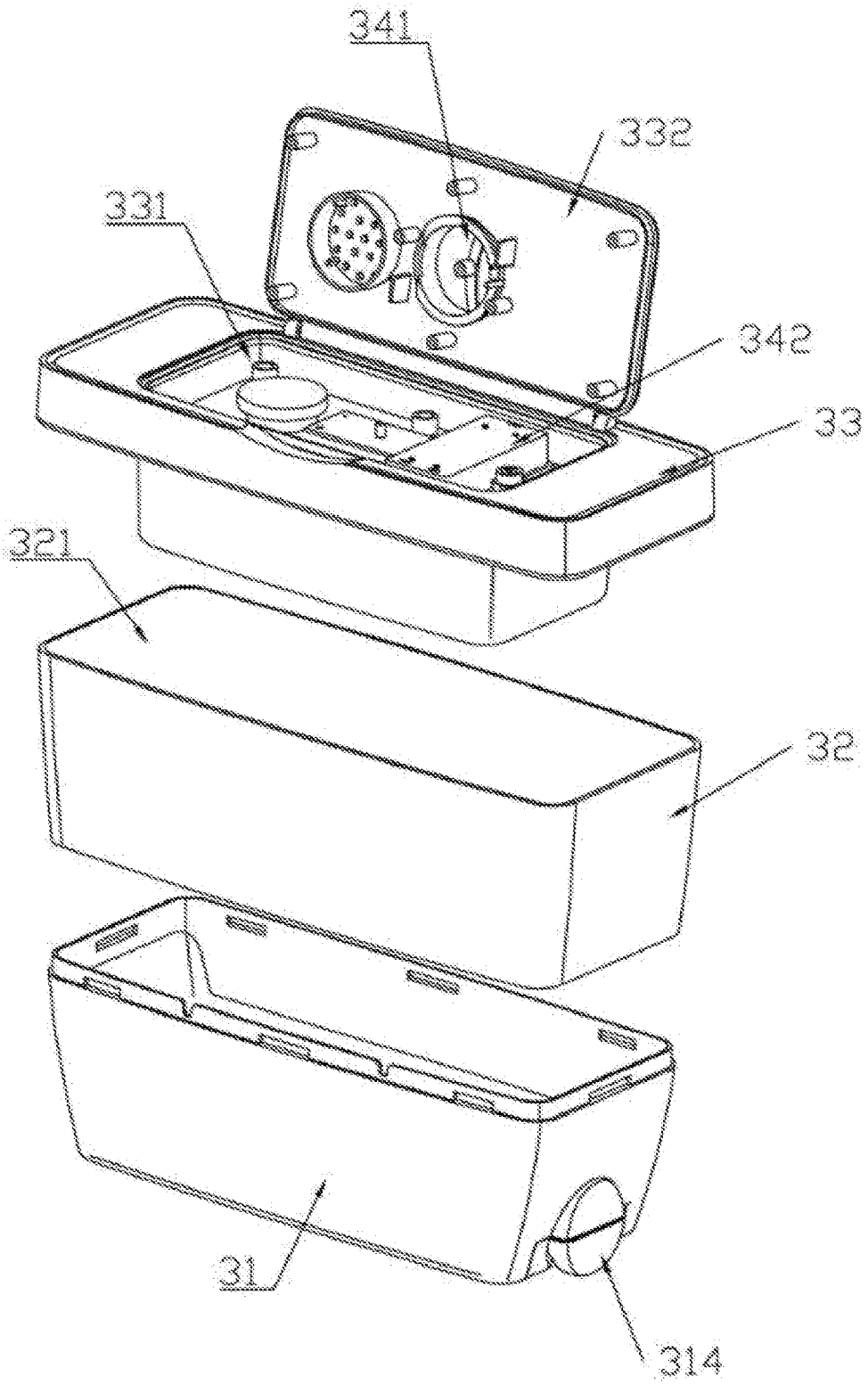
FIG. 10 is an exploded diagram of a first kind of water tank decoration member.

Specifically, as shown in FIG. 8 and FIG. 10, the whole water tank decoration member 3 is square, which includes a base 31, at least one extending wall 32, and an end cover 33. There is only one extending wall 32 in this embodiment.

Figure 11:
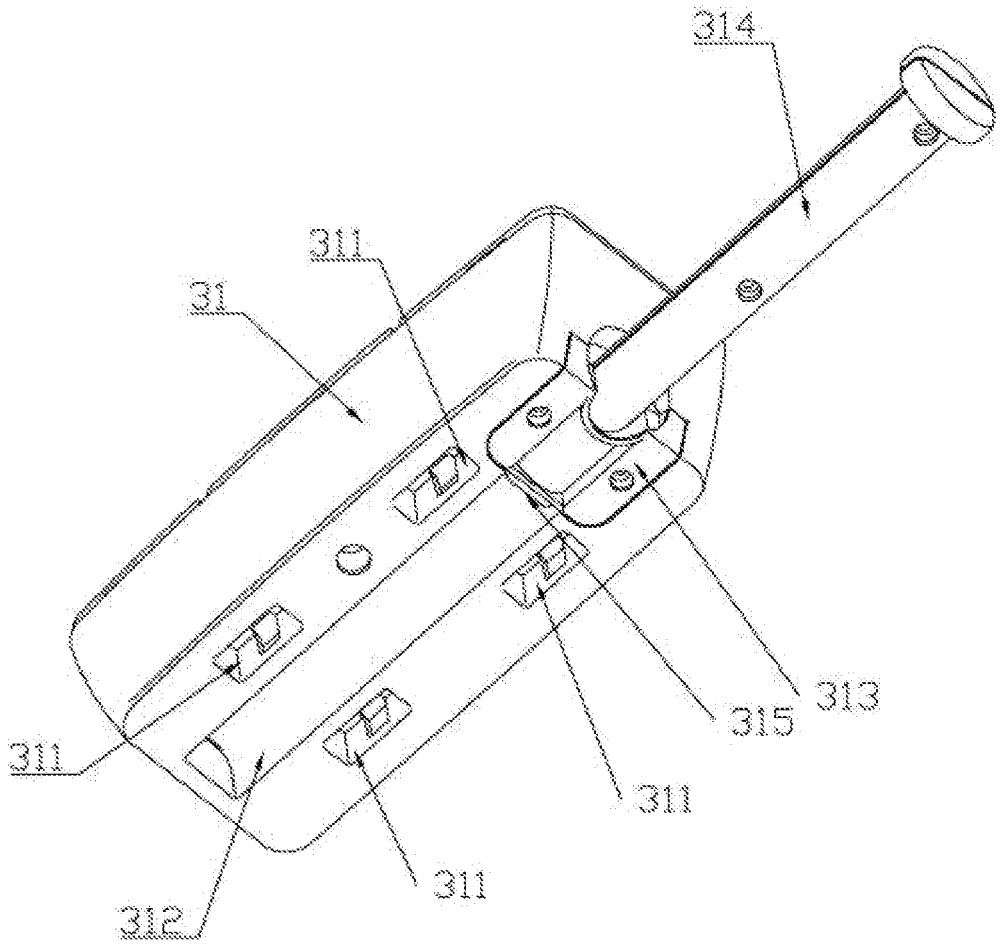
FIG. 11 is a schematic diagram of a bottom of a base.

The base 31 is configured for being detachably connected to the sitting platform 11. With reference to FIG. 2, FIG. 10, and FIG. 11, the sitting platform 11 is provided with several connecting plugs 15. Several connecting slots 311 matched with the connecting plugs 15 are formed in a bottom of the base 31. Corresponding fastener components are arranged on the connecting plugs 15 and the connecting slots 311. The fastener components include barbs arranged on the connecting plugs 15, and barb slots arranged in the connecting slots 311. To mount the base 31, the connecting slots 311 and the connecting plugs 15 can be directly made to be opposite and are fixed and positioned by their fastener components.

In addition, a sliding chute 312 is formed in a bottom of the base 31. Correspondingly, the connecting slots 311 are formed in two sides of the sliding chute. A guide sleeve 313 is fixed at one end of the sliding chute 312, and the other end of the sliding chute is closed. A sliding rod 314 is arranged in the sliding chute 312. One end of the sliding rod 314 is arranged in the guide sleeve 313 in a penetrating manner; and the other end resists against the closed sliding chute 312, and an end portion of the end is provided with a limiting boss 315 configured for abutting against the guide sleeve 313. As shown in FIG. 11, the guide sleeve 313 is fixed at one end of the sliding chute 312 through a screw. During use, the user can pull out the sliding rod 314 with a hand, so that the sliding rod 314 moves outwards along the guide sleeve 313, and is supported by the guide sleeve 313 and the sliding chute 312. After the sliding rod is pulled out at a certain length, the limiting boss 315 abuts against the guide sleeve 313 to stop the sliding rod 314 from being pulled out. The pulled-out sliding rod can be configured for storing objects, for example, hanging roll paper or some tools.

As shown in FIG. 10, the extending wall 32 is an annular plate body. Corresponding fastener structures are arranged at an inner edge of a lower end of the extending wall 32 and a top of the base 31. Fast assembling can be achieved by the fastener structures. The end cover 33 is directly covered on the extending wall 32. The extending wall 32 is hollowed, so that the extending wall 32 is formed into a storage space for storing things.

With reference to FIG. 10 and FIG. 11, a second accommodating cavity 321 is formed in the hollowed extending wall 32. An outer diameter of the extending wall 32 is slightly greater than that of the base 31. When the water tank decoration member 3 is disassembled, the base 31 can be arranged in the second accommodating cavity 321 to fold the water tank decoration member 3, thereby reducing the volume of the water tank decoration member 3 and facilitating the packaging of the potty chair. If there are a plurality of extending walls 32, the plurality of extending walls 32 may have different sizes, so that the plurality of extending walls 32 are sleeved in sequence to achieve folding.

In this embodiment, as shown in FIG. 3, the upper main body 1 is hollowed, so that a third accommodating cavity 16 located below the excrement container 13 may be formed in the upper main body 1. The third accommodating cavity 16 is configured for accommodating the folded water tank decoration member 3 when the upper main body (1) and the lower main body (2) are folded. According to the folding structures of the upper main body 1 and the lower main body 2, to encase the upper main body 1 and the lower main body 2, before the lower end of the upper main body 1 is stored in the first accommodating cavity 21 of the lower main body 2, the folded water tank decoration member 3 can be first placed in the first accommodating cavity, and the upper main body 1 is then placed, so that the water tank decoration member 3 enters the third accommodating cavity 16 through the lower connecting port 19 of the upper main body 1.

Further, a recessed portion 331 is arranged in the end cover 33. A recessed cavity configured for placing an object is formed in the recessed portion 331. A flap cover 332 configured for closing the recessed cavity is arranged at a top of the recessed portion 331. As shown in FIG. 11, the recessed cavity is integrally formed in the end cover 33 during mold shaping of the end cover 33. The flap cover 332 is arranged on the end cover 33 on one side of the recessed portion 331 through a hinge structure. In this patent, the flap cover 332 is located in the middle of the end cover 33. The user can place some wet tissues or other objects in the recessed cavity.

In this embodiment, a simulation toy 34 is arranged in the recessed portion 331. For a water tank of a toilet, a flush button may be arranged at a top of the water tank. The simulation toy 34 in this patent is arranged to simulate a flushing function of the water tank. Specifically, the simulation toy 34 includes a push button 341 and a sound production member 342. The push button 341 passes through the flap cover 332 and is exposed outwards. The sound production member 342 is arranged in the recessed portion 331. The push button 341 is pushed to make the sound production member 342 work to make a flushing sound, thus simulating a flushing effect of the toilet. The simulation toy 34 is arranged to increase the interesting of a child, and the child learns a correct way to use a toilet with the toy and forms a good habit.

Figure 12:
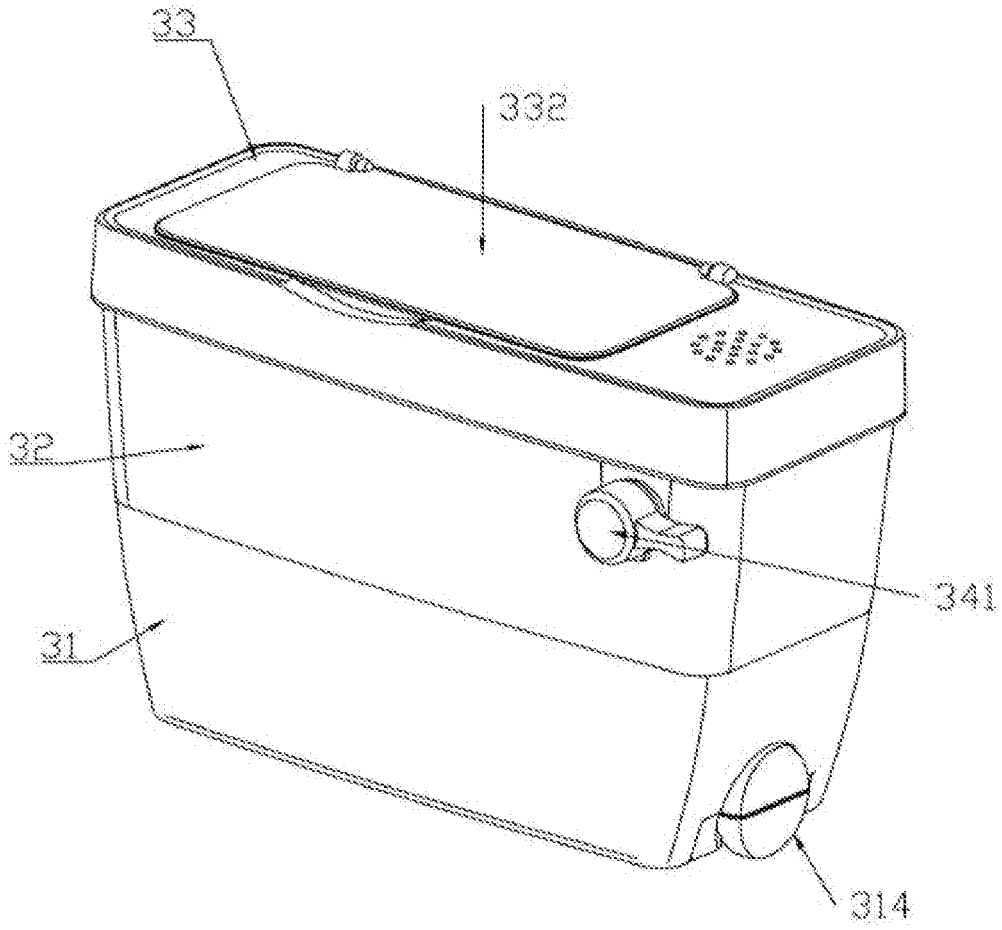
FIG. 12 is a schematic structural diagram of a second kind of water tank decoration member.
Figure 13:
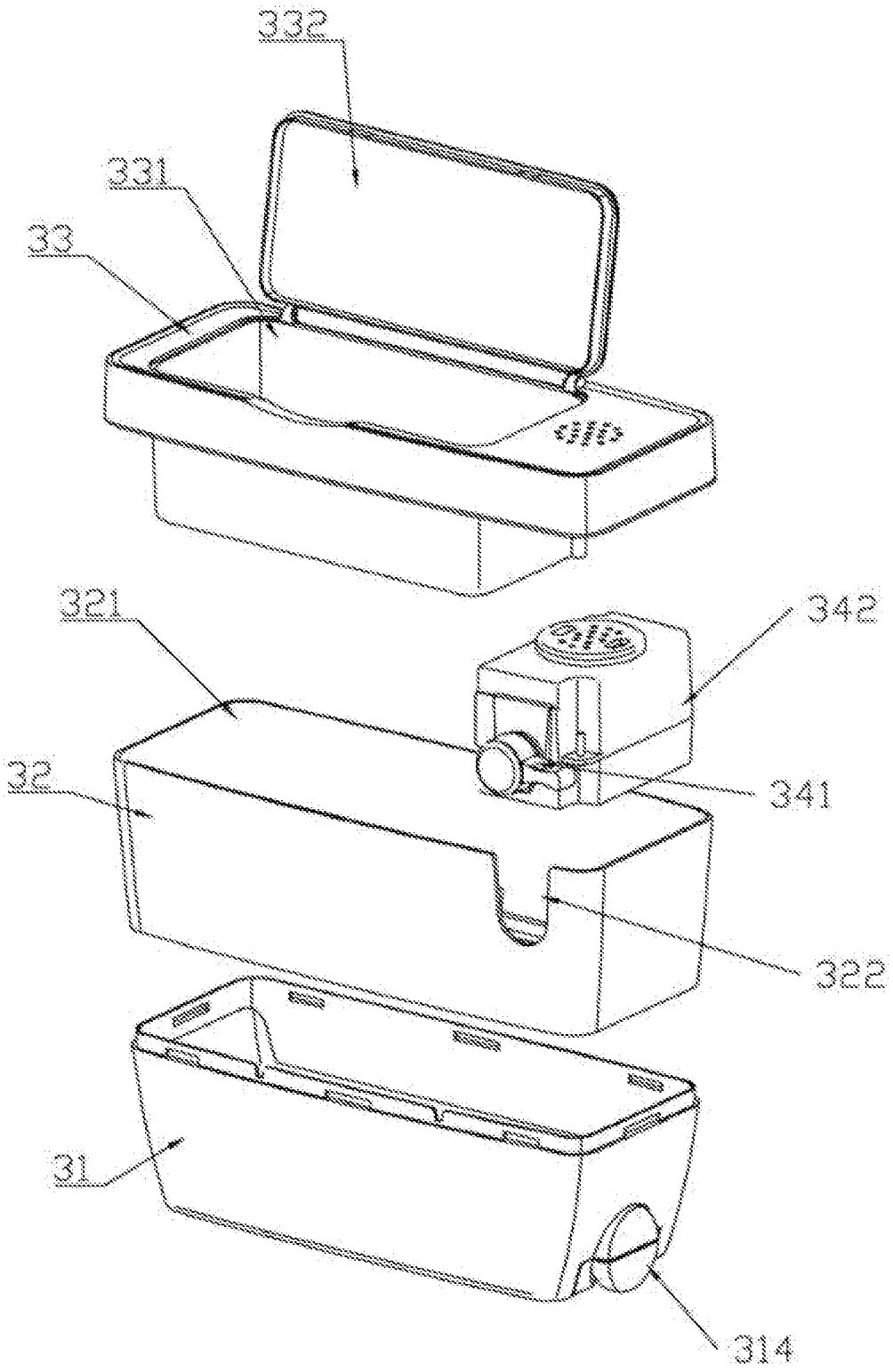
FIG. 13 is an exploded diagram of a second kind of water tank decoration member.

This embodiment also provides a transformation example. Another simulation toy 34 is used. As shown in FIG. 12 and FIG. 13, in this transformation example, the recessed portion 331 is configured for storing an object. A clamping slot 322 is formed in the extending wall 32. The clamping slot 322 is connected with the simulation toy 34. A push button 341 in the simulation toy 34 is a knob, which is configured for simulating some toggle type toilets. The knob is pushed to make a flushing sound.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A potty chair, comprising:

an upper main body (1), wherein a sitting platform (11) is arranged at an upper end of the upper main body (1); an excretion hole and an excrement container (13) mounted in the excretion hole (12) and configured for accommodating excrement are arranged in the sitting platform (11); and a lower main body (2), detachably connected to a lower end of the upper main body (1) and configured for supporting the upper main body (1), wherein a first accommodating cavity (21) is formed in the lower main body (2); when the upper main body (1) is separated from the lower main body (2), a volume formed by stacking the upper main body (1) and the lower main body (2) is reduced by placing the lower main body (2) upside down and placing the lower end of the upper main body (1) in the first accommodating cavity (21).

2. The potty chair according to claim 1, wherein the lower main body (2) is hollowed; an upper connecting port (22) matched with the lower end of the upper main body (1) in size is formed in an upper end of the lower main body (2); an outer diameter of the lower main body (2) gradually increases from the upper connecting port (22) to bottom; and the first accommodating cavity (21) is formed in the lower main body (2).

3. The potty chair according to claim 2, wherein a connecting boss (23) is arranged at an inner edge of the upper connecting port (22); and several corresponding connecting holes are formed in the connecting boss (23) and the upper main body (1).

4. The potty chair according to claim 3, wherein several first connecting seats (24) are arranged on the connecting boss (23); several second connecting seats (14) corresponding to the first connecting seats (24) are arranged on the upper main body (1); the connecting holes are formed in the first connecting seats (24) and the second connecting seats (14); and slots (241) matched with the second connecting seats (14) in shape are formed in upper side surfaces and lower side surfaces of the first connecting seats (24).

5. The potty chair according to claim 1, wherein the upper main body (1) is hollowed; a third accommodating cavity (16) located below the excrement container (13) is arranged in the upper main body (1); and the third accommodating cavity (16) is configured for accommodating accessories of the potty chair when the upper main body (1) and the lower main body (2) are folded.

6. The potty chair according to claim 1, wherein the sitting platform (11) on a rear side of the excretion hole (12) is detachably connected with a water tank decoration member (3); the water tank decoration member (3) comprises:

a base (31), configured for being detachably connected to the sitting platform (11);

at least one extending wall (32), detachably fixed on the base (31); and an end cover (33), detachably fixed on the extending wall (32), wherein a second accommodating cavity (321) matched with the base (31) in size is formed in the extending wall (32); and when the water tank decoration member (3) is disassembled, the base (31) is arranged in the second accommodating cavity (321) to fold the water tank decoration member (3).

7. The potty chair according to claim 6, wherein several connecting plugs (15) are arranged on the sitting platform (11); several connecting slots (311) matched with the connecting plugs (15) are formed in a bottom of the base (31); and corresponding fastener components are arranged on the connecting plugs (15) and the connecting slots (311).

8. The potty chair according to claim 6, wherein a sliding chute (312) is formed in the base (31); a guide sleeve (313) is fixed at one end of the sliding chute (312); a sliding rod (314) is arranged in the sliding chute (312); and one end of the sliding rod (314) is arranged in the guide sleeve (313) in a penetrating manner, and the other end is provided with a limiting boss (315) configured for abutting against the guide sleeve (313).

9. The potty chair according to claim 6, wherein a recessed portion (331) is arranged in the end cover (33); a recessed cavity configured for placing an object is formed in the recessed portion (331); a flap cover (332) configured for closing the recessed cavity is arranged at a top of the recessed portion (331).

10. The potty chair according to claim 6, further comprising a simulation toy (34), configured for simulating operations of a toilet and comprising a push button (341) and a sound production member (342) connected to the push button (341), wherein the push button (341) is pushed to enable the sound production member (342) to work.

11. The potty chair according to claim 6, further comprising a simulation toy (34), configured for simulating operations of a toilet and comprising a push button (341) and a sound production member (342) connected to the push button (341), wherein the push button (341) is pushed to enable the sound production member (342) to work.

12. A potty chair, comprising:

an upper main body (1), a sitting platform (11) disposed at an upper end of the upper main body (1) and comprising a excretion hole; an excrement container (13) mounted in the excretion hole (12) and configured for accommodating excrement disposed in the sitting platform (11); and a lower main body (2), detachably connected to a lower end of the upper main body (1) and configured for supporting the upper main body (1), wherein a first accommodating cavity (21) is formed in the lower main body (2), and the first accommodating cavity (21) is configured for accommodating the lower end of the upper main body (1) when the upper main body (1) is separated from the lower main body (2).

13. The potty chair according to claim 12, wherein the lower main body (2) is hollowed; an upper connecting port (22) matched with the lower end of the upper main body (1) in size is formed in an upper end of the lower main body (2); an outer diameter of the lower main body (2) gradually increases from the upper connecting port (22) to bottom; and the first accommodating cavity (21) is formed in the lower main body (2).

14. The potty chair according to claim 13, wherein a connecting boss (23) is arranged at an inner edge of the upper connecting port (22); and several corresponding connecting holes are formed in the connecting boss (23) and the upper main body (1).

15. The potty chair according to claim 14, wherein several first connecting seats (24) are arranged on the connecting boss (23); several second connecting seats (14) corresponding to the first connecting seats (24) are arranged on the upper main body (1); the connecting holes are formed in the first connecting seats (24) and the second connecting seats (14); and slots (241) matched with the second connecting seats (14) in shape are formed in upper side surfaces and lower side surfaces of the first connecting seats (24).

16. The potty chair according to claim 12, wherein the upper main body (1) is hollowed; a third accommodating cavity (16) located below the excrement container (13) is arranged in the upper main body (1); and the third accommodating cavity (16) is configured for accommodating accessories of the potty chair when the upper main body (1) and the lower main body (2) are folded.

17. The potty chair according to claim 12, wherein the sitting platform (11) on a rear side of the excretion hole (12) is detachably connected with a water tank decoration member (3); the water tank decoration member (3) comprises:

a base (31), configured for being detachably connected to the sitting platform (11);

at least one extending wall (32), detachably fixed on the base (31); and an end cover (33), detachably fixed on the extending wall (32), wherein a second accommodating cavity (321) matched with the base (31) in size is formed in the extending wall (32); and when the water tank decoration member (3) is disassembled, the base (31) is arranged in the second accommodating cavity (321) to fold the water tank decoration member (3).

18. The potty chair according to claim 17, wherein several connecting plugs (15) are arranged on the sitting platform (11); several connecting slots (311) matched with the connecting plugs (15) are formed in a bottom of the base (31); and corresponding fastener components are arranged on the connecting plugs (15) and the connecting slots (311).

19. The potty chair according to claim 17, wherein a sliding chute (312) is formed in the base (31); a guide sleeve (313) is fixed at one end of the sliding chute (312); a sliding rod (314) is arranged in the sliding chute (312); and one end of the sliding rod (314) is arranged in the guide sleeve (313) in a penetrating manner, and the other end is provided with a limiting boss (315) configured for abutting against the guide sleeve (313).

20. The potty chair according to claim 17, wherein a recessed portion (331) is arranged in the end cover (33); a recessed cavity configured for placing an object is formed in the recessed portion (331); a flap cover (332) configured for closing the recessed cavity is arranged at a top of the recessed portion (331).

* * * * *